US005862600A

United States Patent [19]

Leini et al.

[11] Patent Number: 5,862,600

[45] Date of Patent: Jan. 26, 1999

[54] MULTI-POSITION GUIDE BAR FASTENING FOR CHAIN SAW

[75] Inventors: Arvo Leini, Edsbyn; Erik Sundström, Sandviken, both of Sweden

[73] Assignee: Sandvik Aktiebolag, Sandviken, Sweden

[21] Appl. No.: 756,641

[22] Filed: Nov. 26, 1996

[30] Foreign Application Priority Data

Nov. 28, 1995 [SE] Sweden ..... 9504238

[51] Int. Cl.[6] ..... B27B 17/14

[52] U.S. Cl. ..... 30/386; 30/383

[58] Field of Search ..... 30/381, 383, 384, 30/385, 386

[56] References Cited

U.S. PATENT DOCUMENTS

| | | | |
|---|---|---|---|
| 2,845,967 | 8/1958 | Hutchinson . | |
| 3,059,491 | 10/1962 | Hoff et al. . | |
| 3,327,741 | 6/1967 | Merz | 30/386 |
| 3,636,995 | 1/1972 | Newman | 30/386 |
| 3,683,980 | 8/1972 | Gasner . | |
| 3,870,125 | 3/1975 | Gorski | 30/383 |
| 3,955,279 | 5/1976 | Pierson . | |
| 4,211,007 | 7/1980 | Gibson | 30/383 |
| 5,070,618 | 12/1991 | Edlund | 30/386 |
| 5,685,080 | 11/1997 | Amano et al. | 30/383 |

FOREIGN PATENT DOCUMENTS

| | | |
|---|---|---|
| 41 37 409 | 5/1993 | Germany . |
| 469 515 | 7/1993 | Sweden . |

*Primary Examiner*—Hwei-Siu Payer

*Attorney, Agent, or Firm*—Burns, Doane, Swecker & Mathis, L.L.P.

[57] ABSTRACT

A chain saw includes a drive unit having a drive shaft, and a chain guide bar mounted to the drive unit by two bolts. The guide bar is attached to the drive unit by an insert structure which fits into a longitudinal slot of the guide bar. The insert structure can be oriented in at least two different orientations within the slot for establishing different positional relationships, respectively, between the drive shaft and a longitudinal center line of the guide bar. For example, the center line could be offset either above or below the drive shaft, or the center line could intersect the drive shaft.

10 Claims, 1 Drawing Sheet

Fig. 1
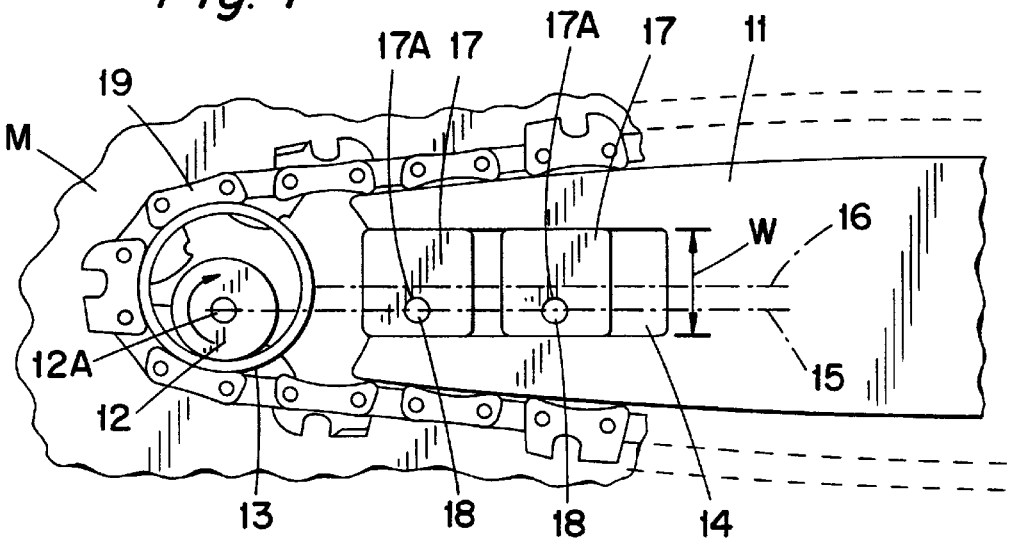
Fig. 2A
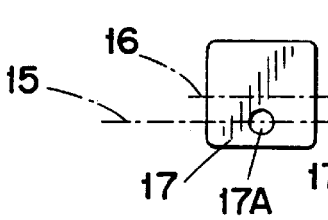
Fig. 2C
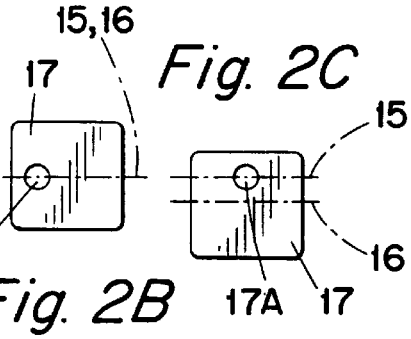
Fig. 2B
Fig. 3
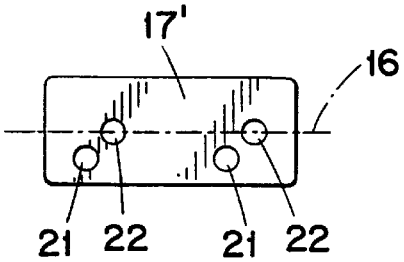
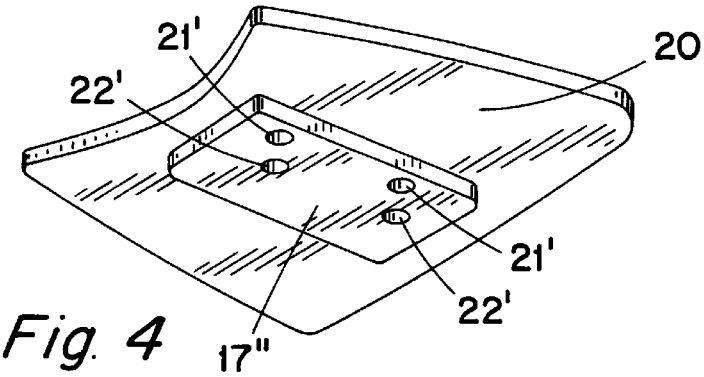
Fig. 4

MULTI-POSITION GUIDE BAR FASTENING FOR CHAIN SAW

BACKGROUND OF THE INVENTION

The present invention relates to chain saw guide bars and in particular to an arrangement for mounting a guide bar to a chain saw housing.

Chain saw guide bars are normally attached to the machine unit of a chain saw by two threaded bolts penetrating a longitudinal slot at the rear end of the guide bar, allowing a longitudinal displacement of the guide bar which is needed when replacing a saw chain or compensating for wear of the chain.

Commonly, the guide bar is symmetric with the slot along a longitudinal center line of the guide bar, making it possible to turn the guide bar over to wear both sides of the bar equally. Behind the guide bar is a drive shaft with a drive sprocket for the chain. The bolts are often located to cause the bar center line to pass through the drive shaft, as disclosed in U.S. Pat. No. 3,683,980 and U.S. Pat. No. 3,955,279, but it is also known to cause the center line to pass below the shaft as disclosed in U.S. Pat. No. 2,845,967, U.S. Pat. No. 2,910,100 and U.S. Pat. No. 3,059,491 to allow a larger deflection of the slack upper part of the chain. With the introduction of self-tensioning drive sprockets as shown in DE 41 37 409 or SE 469 515 it has also been suggested to cause the bar centerline to pass above the drive shaft.

SUMMARY OF THE INVENTION

The present invention involves a mounting arrangement for chain saw guide bars, enabling the bar center line to be selectively disposed in a least two positional relationships relative to the drive shaft, e.g., the center line can be made to pass above, through or below the drive shaft according to the service conditions.

BRIEF DESCRIPTION OF THE DRAWING

A preferred embodiment of the invention is described with reference to the appended figures, where:

FIG. 1 is a side view of a chain saw with a guide bar attached by means of a first type of insert structure according to the invention, with the center line of the guide bar spaced above a drive shaft;

FIGS. 2A, 2B and 2C are side views of an insert shown in FIG. 1, the insert disposed in three different orientations for establishing respective positional relationships between the center line and the drive shaft; in FIG. 2A the center line is offset above the drive shaft; in FIG. 2B the center line intersects the drive shaft; in FIG. 2C, the center line is offset below the drive shaft;

FIG. 3 is a side view of a second type of insert according to the insert; and FIG. 4 is a perspective view showing the type of insert of FIG. 3 joined to a clamping plate.

DETAILED DESCRIPTION OF PREFERRED EMBODIMENTS OF THE INVENTION

A saw chain (19) is driven by a drive sprocket (12) mounted on a drive shaft (12A) to travel around a guide bar (11). The drive sprocket loosely supports an outer drive ring (13) the center of which will occupy an equilibrium position above the drive shaft during a sawing operation. The saw machine unit M is provided with two bolts (18). A reference line (15) intersecting the axes of the bolts also intersects the axis of the shaft (12A) of the drive sprocket (12). To make the chain pass smoothly from the drive ring (13) to the upper side of the guide bar (11) the bar center line (16) is parallel to, and offset upwards from, the line (15). To accomplish this, the guide bar is made with a slot (14) having a width (W) substantially wider than the diameters of bolts (18). The slot is preferably symmetrically located with respect to the center line (16) to allow reversing of the bar and thereby enable the bar to be evenly worn. In the slot (14) are placed one or more inserts (17) having holes (17A) adapted to receive the bolts (18). The inserts can be placed in different angular positions within the slot, in order to change the orientation of the center line (16) with respect to line (15), and thus with respect to the drive shaft (12A).

In FIG. 1 the inserts (17) are of square shape and are placed such that the holes (17A) are disposed below the slot center line (16). FIGS. 2A–2C show how such square inserts (17) can be selectively placed in at least three positions to locate the holes (17A) below the center line (16) (FIG. 2A), above the center line (16) (FIG. 2C) or on the center line (16) (FIG. 2B). The position of the inserts will be selected in accordance with the particular operating conditions. In each of those positions, the lines (15) and (16) are parallel to one another. (Note: As used herein, the term "parallel" includes the case where the lines (15) and (16) coincide with one another (FIG. 2B)).

FIG. 3 shows a modified insert (17') of elongated rectangular shape, having four holes, two of which (22) lie on the center line (16) and two (21) of which are offset from the center line. By reversing the insert, the offset holes (21) can be located below or above the center line (16). If available space on the insert is very restricted, the holes may touch or slightly intersect each other. Thus, there is a first pair of holes 22, and a second pair of holes 21, the pairs being spaced apart in a direction perpendicular to the center line (16) and reference line (15). In use, the bolts (18) could be mounted in the holes (22), whereby the lines (15 and 16) would coincide with one another. Alternatively, the bolts could be mounted in holes (21), whereby the line (16) would be offset above the line (15). Also alternatively, the insert (17') could be reversed, so that the holes (21) are offset above the holes (22). By then mounting the bolts in the holes (21), the line (16) would be offset below the line (15).

Traditionally, the guide bar (11) is attached to the machine unit by fitting a clamping plate with two bolts holes outside the guide bar. The clamping plate is wider than the slot (14) and with one nut on each bolt, the clamping plate and the guide bar are fastened to the machine unit. If one wishes to use such a conventional clamping plate with the present invention because it is part of or coacts with the machine cover, the inserts should have a thickness not exceeding the thickness of the guide bar (11).

In certain cases such as when mounting a guide bar on a vehicle-mounted chain saw, the clamping plate may have functions related to the guide bar geometry, such as producing alignment between certain liquid supply channels, or providing an auxiliary chain guide. In such cases the position of the clamping plate relative to the bar should be retained, and as shown in FIG. 4 the clamping plate (20) should have four holes (21') and (22') and could be made integral with a four hole insert (17") of the type shown in FIG. 4. To ensure stiff clamping, the insert (17") should have a thickness not exceeding the bar thickness.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed:

1. A chain saw comprising:

a drive unit including a drive shaft;

a guide bar mounted to the drive unit by a plurality of bolts, the guide bar defining a longitudinal center line, the guide bar including a longitudinal slot; and an insert structure disposed within the slot, the insert structure connected to the bolts for attaching the guide bar to the drive unit, the insert structure being mountable in at least first and second different orientations within the slot for establishing first and second different positional relationships, respectively, between the center line and the drive shaft;

wherein the insert structure comprises first and second inserts connected to respective ones of the bolts, each of the inserts including a hole for receiving a respective bolt, the hole being offset from a geometric center of the insert, the location of the hole relative to the center line being different in the respective first and second orientations, each of the inserts being of square shape and selectively mountable in three orientations in the slot, the location of the hole relative to the center line being different in the respective three orientations, each of the inserts being of square shape and selectively mountable in three orientations in the slot, the location of the hole relative to the center line being different in the respective three orientations.

2. A chain saw comprising:

a drive unit including a drive shaft;

a guide bar mounted to the drive unit by a plurality of bolts, the bolts intersected by a common reference line, the guide bar defining a longitudinal center line, the guide bar including a longitudinal slot; and an insert structure disposed within the slot, the insert structure connected to the bolts for attaching the guide bar to the drive unit, the insert structure being mountable in at least first and second different orientations within the slot for establishing at least first and second different positional relationships, respectively, between the center line and the drive shaft, the center line being parallel to the reference line in said different positional relationships.

3. The chain saw according to claim 2 wherein the first and second positional relationships involve the center line being offset respectively above and below the drive shaft.

4. The chain saw according to claim 2 wherein the insert structure is mountable in first, second, and third orientations within the slot for establishing first, second, and third positional relationships, respectively, between the center line and the drive shaft, the first positional relationship comprising the center line intersecting the drive shaft, and the second and third positional relationships comprising the center line being offset respectively above and below the drive shaft.

5. The chain saw according to claim 2 wherein the insert structure comprises first and second inserts connected to respective ones of the bolts, each of the inserts including a hole for receiving a respective bolt, the hole being offset from a geometric center of the insert, the location of the hole relative to the center line being different in the respective first and second orientations.

6. The chain saw according to claim 5 wherein each of the inserts is of rectangular shape.

7. The chain saw according to claim 2 wherein the reference line intersects the drive shaft.

8. The chain saw according to claim 2 wherein the center line passes through the drive shaft in one of the parallel positional relationships.

9. A chain saw comprising:

a drive unit including a drive shaft;

a guide bar mounted to the drive unit by a plurality of bolts, the guide bar defining a longitudinal center line, the guide bar including a longitudinal slot; and an insert structure disposed within the slot, the insert structure connected to the bolts for attaching the guide bar to the drive unit, the insert structure being mountable in at least first and second different orientations within the slot for establishing first and second different positional relationships, respectively, between the center line and the drive shaft;

wherein the insert structure comprises a single insert connected to the bolts, the insert including two pairs of holes for receiving the bolts, the pairs of holes being spaced apart in a direction perpendicular to the center line.

10. The chain saw according to claim 9, further including a clamping plate joined to one side of the insert and being larger than the insert and the slot.

* * * * *